US006244011B1

(12) United States Patent
Esser

(10) Patent No.: US 6,244,011 B1
(45) Date of Patent: Jun. 12, 2001

(54) INVERTED V-SHAPED DISPLAY FRAMEWORK

(75) Inventor: Richard A. Esser, Glenn Dale, MD (US)

(73) Assignee: TVI Corporation, Glen Dale, MD (US)

( * ) Notice: Subject to any disclaimer, the term of this patent is extended or adjusted under 35 U.S.C. 154(b) by 0 days.

(21) Appl. No.: 09/399,944

(22) Filed: Sep. 20, 1999

Related U.S. Application Data

(60) Provisional application No. 60/101,253, filed on Sep. 21, 1998.

(51) Int. Cl.[7] ..... E04H 12/18

(52) U.S. Cl. ..... 52/646; 40/16; 52/646; 52/655.1; 135/131; 135/145; 135/147; 248/165; 248/166; 248/170; 403/170; 403/171; 403/174; 403/217

(58) Field of Search ..... 40/16, 606; 403/174, 403/170, 171, 217; 248/165, 166, 170; 135/131, 145; 52/646

(56) References Cited

U.S. PATENT DOCUMENTS

| | | | |
|---|---|---|---|
| 3,140,563 | 7/1964 | Allen . | |
| 3,810,482 | 5/1974 | Beavers . | |
| 4,422,646 | 12/1983 | Rosa . | |
| 4,450,851 | 5/1984 | Beavers . | |
| 4,546,983 | 10/1985 | Rosa . | |
| 4,637,748 | 1/1987 | Beavers . | |
| 4,829,735 | 5/1989 | Zwissler . | |
| 4,942,686 | 7/1990 | Kemeny . | |
| 5,144,784 | 9/1992 | Marti . | |
| 5,230,196 | 7/1993 | Zeigler . | |
| 5,274,980 | 1/1994 | Zeigler . | |
| 5,328,286 | 7/1994 | Lee . | |
| 5,794,640 * | 8/1998 | Jang | 403/174 |

OTHER PUBLICATIONS

Mobiflex Shelter System Command Post Manual, Special Item No. F5038, Mfg. Item No. 92500, MS 2.5, 1990.

Pop "N" Work Product Line Brochure distributed by FOF Product Incorp., 1994 (2 pages).

Free Standing Integral Frame Industrial Tents Brochure distributed by T.A. Pelsue Co., 1993.

* cited by examiner

*Primary Examiner*—Carl D. Friedman
*Assistant Examiner*—Christy M. Syres
(74) *Attorney, Agent, or Firm*—Finnegan Henderson Farabow Garret & Dunner, LLP

(57) ABSTRACT

A display framework collapsing from an inverted V-shaped display framework to a compact configuration includes rods, hubs, and a fastening mechanism. Each rod pivotally joins to another rod by a scissors-type connection intermediate the rod ends. In addition, the end portion of each rod pivotally joins to a hub, where each hub may receive a plurality of rods. As configured, each rod enjoys pivotal movement in relation to the hub along a single axis of revolution. The rods rotate about this single axis of revolution from the collapsed compact configuration, where the rods are substantially parallel to one another, to the erect inverted V-shaped configuration, where the rods radiate outwardly from one another and the display framework includes a front face, a rear face, and a top. In this erect configuration, the display framework provides display surfaces on both the front and rear faces. To enhance the stability of the erect inverted V-shaped display framework, the fastening mechanism connects the front face to the rear face.

19 Claims, 10 Drawing Sheets

INVERTED V-SHAPED DISPLAY FRAMEWORK

This application claims benefit to U.S. Provisional 60/101,253, filed Sep. 21, 1998.

BACKGROUND OF THE INVENTION

1. Field of the Invention

The present invention relates to portable display frames. More particularly, the present invention concerns an erect inverted V-shaped display framework that is collapsible to a compact configuration.

2. Description of the Prior Art

Display frames have enjoyed a wide array of usage. Recently, consumer demands have increased for display frames that are adaptable for use at such events as trade shows or sporting contests. In response to this increased consumer demand, the display frame industry has seen a trend toward the development and use of more creative designs for the display frame or stand. This trend towards creativity, however, has also lead towards complex display frame structures. These complex designs have created a void in the industry for the enhanced development of display frames of basic appeal, such as a collapsible inverted V-shaped framed.

The inverted V-shaped frame offers many advantages beyond its simplicity. Conventional display frames typically offer an inflexible display surface constructed of either wood, plastic or cardboard material. As constructed, these display surfaces are generally rigid and do not facilitate a collapsible display structure. The inverted V-shaped frame of the present invention, however, employs fabric displays, which offer significant advantages in appearance, artistic flexibility, and handling.

In addition to offering an adaptable and aesthically pleasing display surface, the inverted V-shaped frame may act as a barrier. As a barrier, the inverted V-shaped frame may be used, for example, to enclose certain areas, such as playing surfaces in a sporting event, or may be used to restrain vehicle or pedestrian movement, such as the blocking of a road or the barricading of a construction area. Although these various barrier functions typically require a fixed structure, conventional display frame designs have provided portable display signs resembling a barrier. But these conventional display signs have failed to successfully combine the strengths of a portable display frame and a barrier. For example, the conventional designs have neither optimized the compactness of a collapsed configuration nor minimized the weight of the foldable display sign. Further, the conventional display signs typically possess insufficient rigidity to serve as a barrier once manipulated into the erect configuration, because they do not have an effective mechanism for anchoring them in place to withstand certain external forces.

This void in the industry has created a specific need for a portable display framework having a rigid erect inverted V-shaped configuration which is collapsible to a compact configuration, and where the structural elements of the display framework minimizes the weight of the display framework.

SUMMARY OF THE INVENTION

The advantages and purposes of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the invention comprises a display framework adapted to support a display. The display framework is moveable between an erect inverted V-shaped configuration and a collapsed compact configuration. The display framework in the inverted V-shaped configuration has a top, a front face, and a rear face. In this configuration, the framework provides a display surface on both the front and rear face. To assist in its manipulation, the display framework includes rods, hubs, and a fastening mechanism. Each of the rods pivotally join to another rod by a scissors connection intermediate the ends of the rods. The hub receives an end portion of at least two rods along separate axes of the hub. The rods are pivotally joined to the hub and pivot in relation to the hub along a single axis of revolution. The rods rotate about the single axis of revolution from the collapsed configuration, where the rods are substantially parallel to one another, to the erect inverted V-shaped configuration. In the erect configuration, the fastening mechanism rigidly connects the front face of the framework to the rear face of the framework.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DESCRIPTION OF THE PREFERRED EMBODIMENT(S)

Reference will now be made in detail to the present preferred embodiments of the invention, examples of which are illustrated in the accompanying drawings. Wherever possible, the same reference numbers will be used throughout the drawings to refer to the same or like parts.

In accordance with the present invention, there is provided a collapsible display framework adapted to support a display. In order to easily transport and assemble the framework and alleviate the problems facing conventional display systems, the present invention includes a collapsible framework whose application allows manipulation of the framework from an erect inverted V-shaped configuration to a collapsed compact configuration. The structure of the framework includes rods, hubs, and a fastening mechanism. To assist in the aforementioned manipulation of the collapsible display framework, each rod pivotally joins to another rod by a scissors connection intermediate the ends of the rod, and an end portion of each rod pivotally joins to a hub for rotation about a single axis of revolution in relation to the hub. In the collapsed compact configuration, the rods are substantially parallel to one another. In the erect inverted V-shaped configuration, the rods radiate outwardly from one another. In the erect inverted V-shaped configuration, the fastening mechanism connects a front face of the framework to a rear face of the framework to enhance the rigidity and stability of the erect inverted V-shaped display framework.

Figure 1A:
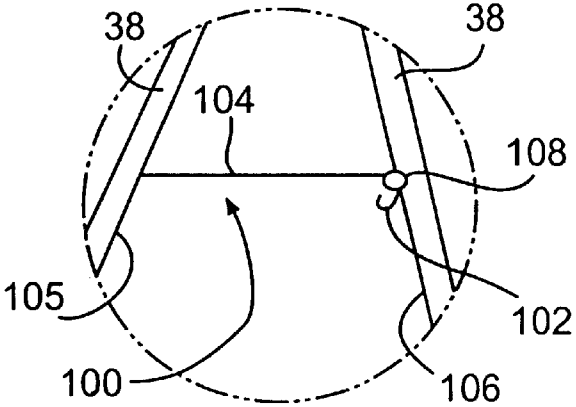
FIG. 1A is an exploded view of the first variation of the fastening mechanism incorporated in the display framework of the present invention.
Figure 1:
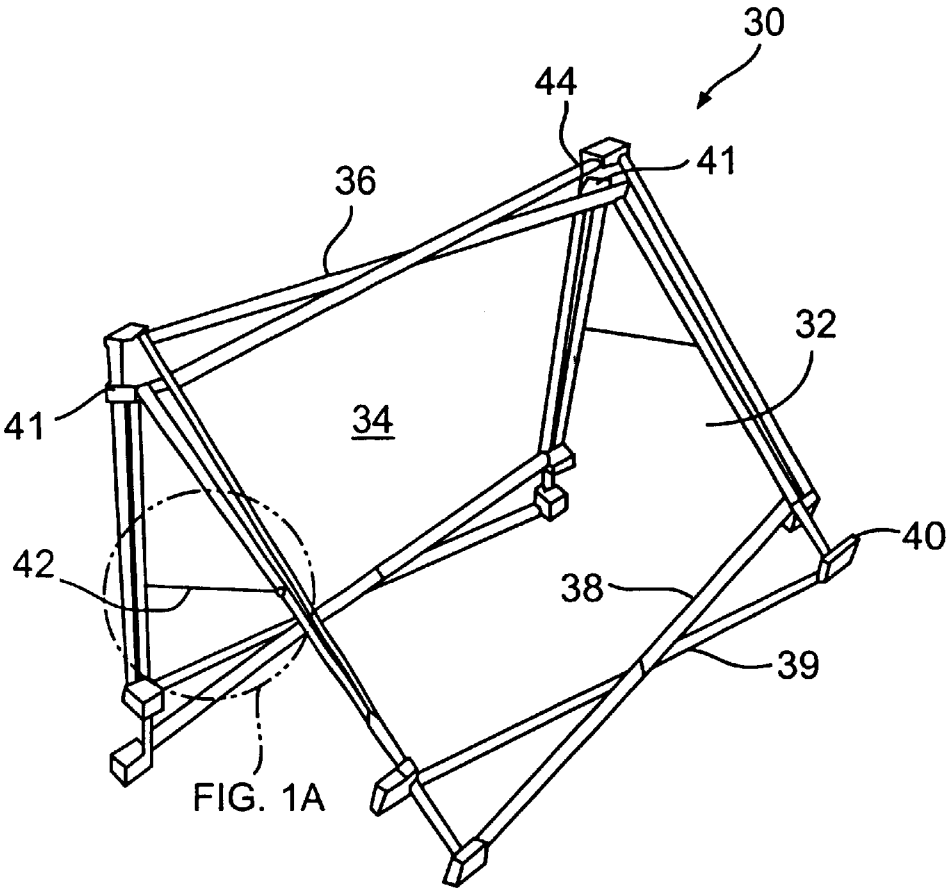
FIG. 1 is a perspective view of a preferred embodiment of the display framework according to the present invention, showing a first variation of a fastening mechanism.

A preferred embodiment of display framework 30 of the present invention is generally depicted in FIGS. 1–8. As illustrated in FIG. 1, framework 30, in the erect inverted V-shaped configuration, includes front face 32, rear face 34, top 36, rods 38, hubs 40, and fastening mechanism 42. As configured, framework 30 provides a display surface on both front face 32 and rear face 34. Each rod 38 pivotally joins to another rod 38 by a scissors type connection 39 intermediate the ends of rod 38. This scissors type connection permits the pivotally joined rods to pivot with respect to one another so that display framework 30 may easily collapse from the erect inverted V-shaped framework configuration. The particular placement of the scissors type connection 39 affects the shape of the display structure as well as the rigidity of the erect framework.

Each rod 38 also pivotally joins to a particular hub 40 at end portion 44. Preferably, a spacer disk is positioned at the pivot connection of the rod 38 to hub 40 to assist in maintaining the alignments of the rods relative to hub 40, and control the torsional movement of the rods as display framework 30 experiences tension. The pivotal connection of rod 38 to hub 40 provides for the rotation of rod 38 relative to hub 40 about a single axis of revolution. This pivotal connection also assists in the eased manipulation of display framework 30 between the collapsed compact configuration and the erect inverted V-shaped configuration. Preferably, each hub 40 receives at least two rods 38, where hubs 40 proximate top 36 receives at least three rods 38. Rods 38 rotate about their respective single axis of revolution from the collapsed compact configuration, where rods 38 are substantially parallel to one another to the erect inverted V-shaped configuration, where rods 38 radiate outwardly from one another, as depicted in FIG. 1.

Each of rods 38 are preferably of equal length and surface area so that the display framework may be easily manipulated between the erect and compact configurations. The dimensions of the rods, however, do not limit the size of the display framework in the erect configuration. For example, certain rods may include a telescoping member residing within the interior of the rod and extending in relation to the rod in the erect inverted V-shaped configuration. The telescoping member, as disposed, possess a smaller surface area than the interior of the rod so that the telescoping member may easily move in relation to the rod. Before or after extension, the telescoping member is secured within the rod by a pin and hole configuration, where the rod and telescoping member includes a hole for the receipt of a pin. Either one of the rod or the telescoping member includes a plurality of holes disposed at varying lengths, such that the extension of the telescoping member may be controlled at different intervals. By varying the extension of the telescoping member in relation to the hub, the size of the erect display framework is easily increased.

In order for display framework 30 to assume a compact configuration from the erect inverted V-shaped configuration, hub 40 has a reduced size that not only possess sufficient rigidity but also enables ease of assembly. In addition, this reduced size minimizes the weight of display framework 30. While several variations of hubs 40, 60, 70, 80, 90 are contemplated by the present invention, the purpose of the hub is satisfied in each design. As designed, the hub assists in the manipulation of the display framework between the erect inverted V-shaped configuration and the collapsed compact configuration.

Figure 2:
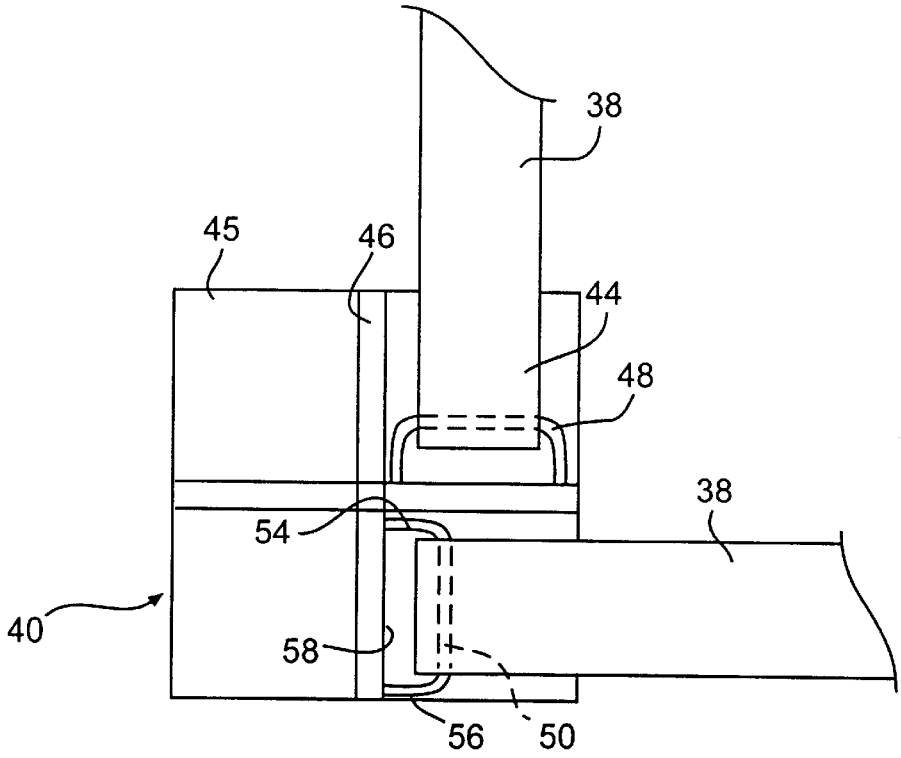
FIG. 2 is a top view of a first variation of the hub incorporated in the display framework of the present invention.

The first embodiment of hub 40 is depicted in expanded detail in FIG. 2. As illustrated, hub 40 includes base portion 45 and flanges 46, whereby flanges 46 project from base portion 45 and pivotally support end portion 44 of rod 38. Flanges 46 are arranged such that the rods connected to any one hub 40 are received along separate axes of hub 40. Preferably, flanges 46 are arranged substantially perpendicular to one another so that hub 40 receives rods 38 along a first axis and a second axis perpendicular to the first axis. Rods 38 pivotally connect to hub 40 by staple pin 48. As illustrated, staple pin 48 inserts through hole 50 located at end portion 44 of rod 38. Each end 54, of staple pin 48 is received along surface 58 of flange 46. End portion 44, as joined by staple pin 48, pivots along a single axis of revolution in relation to hub 40.

Figure 2A:
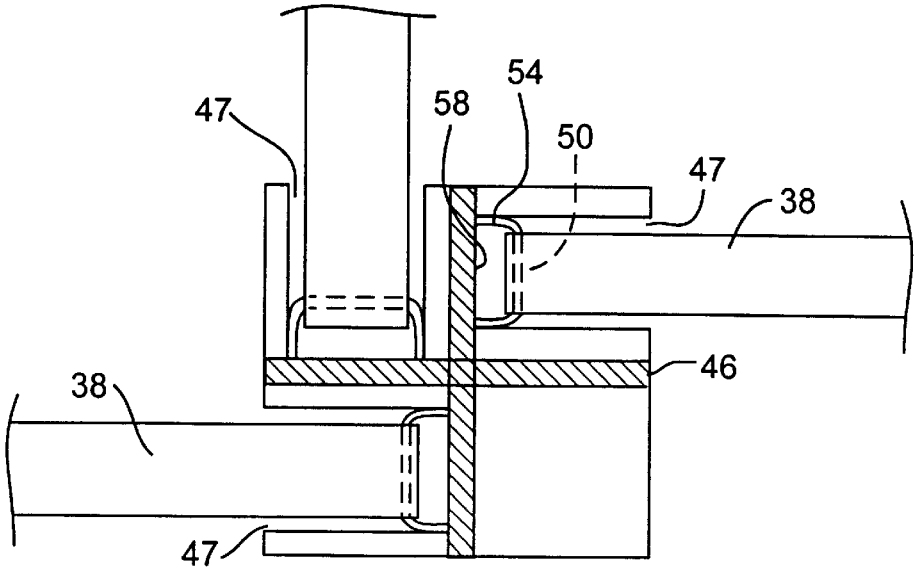
FIG. 2A is a top view of the first variation of the hub incorporated in the display framework of the present invention.

To permit the manipulation of the display framework from the stable erect inverted V-shaped configuration to the collapsed compact configuration, at least two of hubs 41 positioned proximate top 36 include base portion 45, as illustrated in FIG. 2A. Base portion 45 presents openings 47 that allow rods 38 to enjoy full rotation about the single axis of revolution. Alternatively, base portion 45 may include a recess formed by the union of flanges 46 and base portion 45. The recess would limit the articulation of its respective rod to approximately 180°. Because each rod enjoys different degrees of rotation, the display framework is easily collapsed from the erect configuration to the compact configuration.

Figure 3:
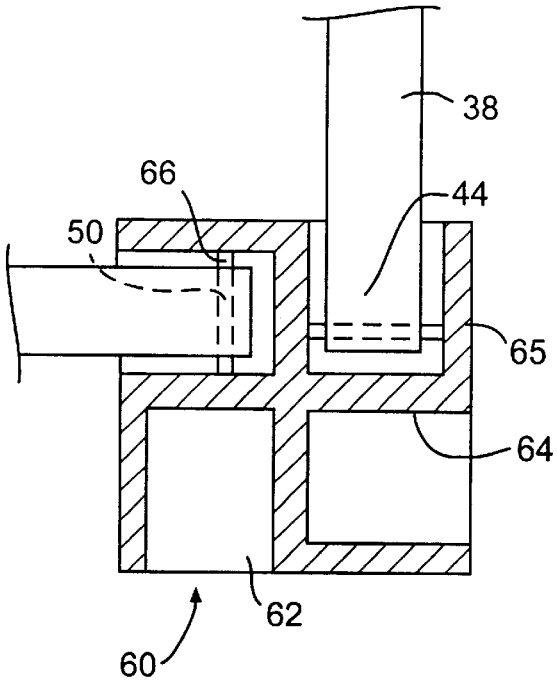
FIG. 3 is a top view of a second variation of the hub incorporated in the display framework of the present invention.

As illustrated alternatively in FIG. 3, second hub 60 includes second base portion 62 and second flanges 64, whereby flanges 64 again project from base portion 62. In comparison to flanges 46 of hub 40, flange 64 includes an end 65 that bends at a right angle in either a clockwise or counterclockwise direction. Flanges 64 pivotally support end portion 44 of rod 38, and are arranged such that the rods connected to any one hub 60 are received along separate axes of hub 60. Preferably, flanges 64 are arranged substantially perpendicular to one another so that hub 60 receives rods 38 along a first axis and a second axis perpendicular to the first axis.

End portion 44 of rod 38 pivotally joins to hub 60 by pin 66. As illustrated in FIG. 3, pin 66 extends from end 65 to flange 64, and inserts through hole 50 located at end portion 44 of rod 38. End portion 44, as joined by pin 66, pivots along a single axis of revolution in relation to hub 40.

Figure 3A:
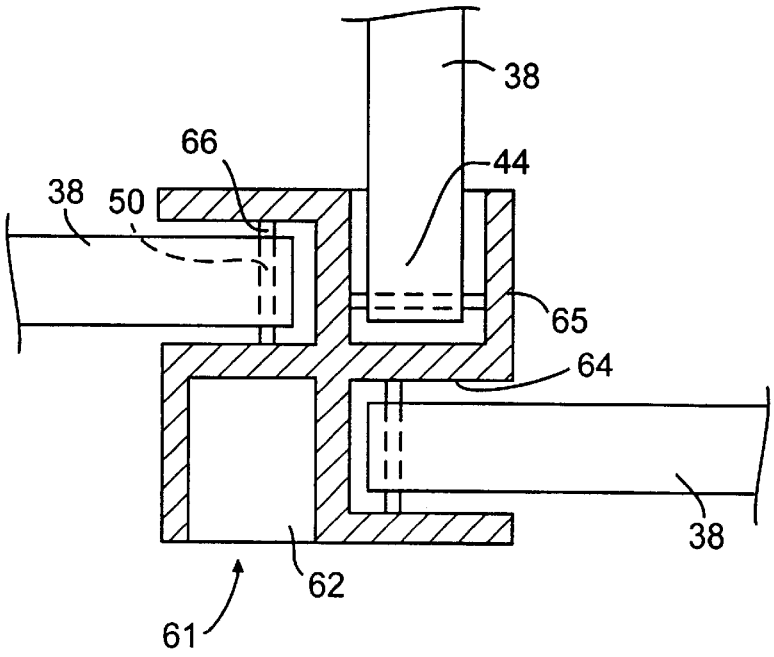
FIG. 3A is a top view of the second variation of the hub incorporated in the display framework of the present invention.

Similar to the first hub embodiment, third hubs 61 positioned proximate top 36 include third base portion 67, as illustrated in FIG. 3A. Base portion 67 presents third openings 68 that allow rods 38, pivotally joined to hub 41, to enjoy fill rotation about the single axis of revolution. Again, because these rods enjoy such full rotation, the display framework easily collapses from the erect configuration to the compact configuration.

Figure 4:
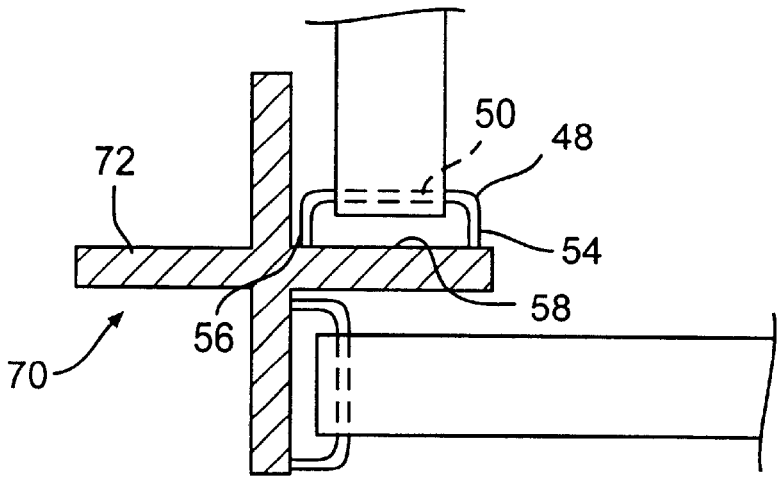
FIG. 4 is a top view of a third variation of the hub incorporated in the display framework of the present invention.

In yet another variation, as illustrated in FIG. 4, fourth hub 70 of display frame 30 includes fourth flanges 72. Essentially identical to hub 40, hub 70 does not include a base portion. Flanges 72 pivotally support end portion 44 of rod 38 and are arranged such that the rods connected to any one hub 70 are received along separate axes of hub 40. Again, flanges 72 are preferably arranged substantially perpendicular to one another so that hub 70 receives rods 38 along a first axis and a second axis perpendicular to the first axis.

End portion 44 of rod 38 pivotally connects to hub 70 by staple pin 48. As illustrated in FIG. 4, staple pin 48 inserts through hole 50 located at end portion 44 of rod 38. Each end 54, 56 of staple pin 48 is received along surface 58 of flange 46. End portion 44, as joined by staple pin 48, pivots along a single axis of revolution in relation to hub 70. Because hub 70 does not include a base portion, rods 38 enjoy full rotation about the single axis of revolution. As previously described, this full rotation enables the display framework to easily collapse from the erect configuration to the compact configuration.

Figure 5:
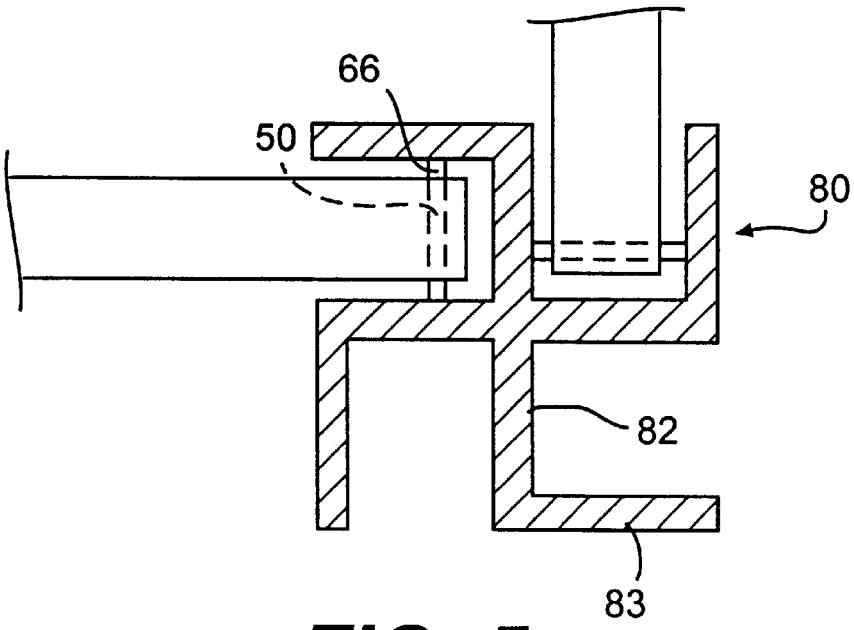
FIG. 5 is a top view of a fourth variation of the hub incorporated in the display framework of the present invention.

In still another variation, as illustrated in FIG. 5, fifth hub 80 includes fifth flanges 82, where ends 83 of flange 82 are bent at right angles in either a clockwise or counter clockwise direction. Similar to flange 64, flanges 82 pivotally support end portion 44 of rod 38, and are arranged such that the rods connected to any one hub 80 are received along separate axes of hub 80. Preferably, flanges 82 are arranged substantially perpendicular to one another so that hub 80 receives rods 38 along a first axis and a second axis perpendicular to the first axis.

As previously described and as depicted in FIG. 5, end portion 44 of rods 38 pivotally joins to hub 80 by pin 66, where pin 66 extends through hole 50 of end portion 44. Because hub 80 does not include a base portion, rods 38 enjoy full rotation about a single axis of revolution in relation to hub 80. This full rotation permits the erect display framework to easily collapse into the compact form.

Figure 6:
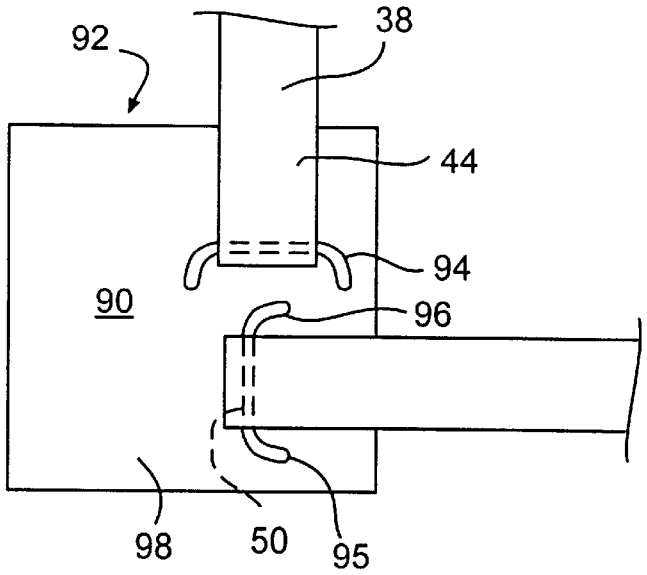
FIG. 6 is a top view of a fifth variation of the hub incorporated in the display framework: of the present invention.

In still a further variation, as illustrated in FIG. 6, sixth hub 90 includes only sixth base portion 92. Base portion 92 pivotally supports end portion 44 of rod 38 by staple pin 94. Staple pin 94 inserts through hole 50 located at end portion 44 of rod 38. Each end 95, 96 of staple pin 94 is received along surface 98 of base portion 92. Each end portion 44, as joined by staple pin 94, pivots along a single axis of revolution in relation to hub 90. Staple pins 94 are preferably arranged such that the rods connected to any one hub are received along a first axis and a second axis perpendicular to the first axis.

Figure 6A:
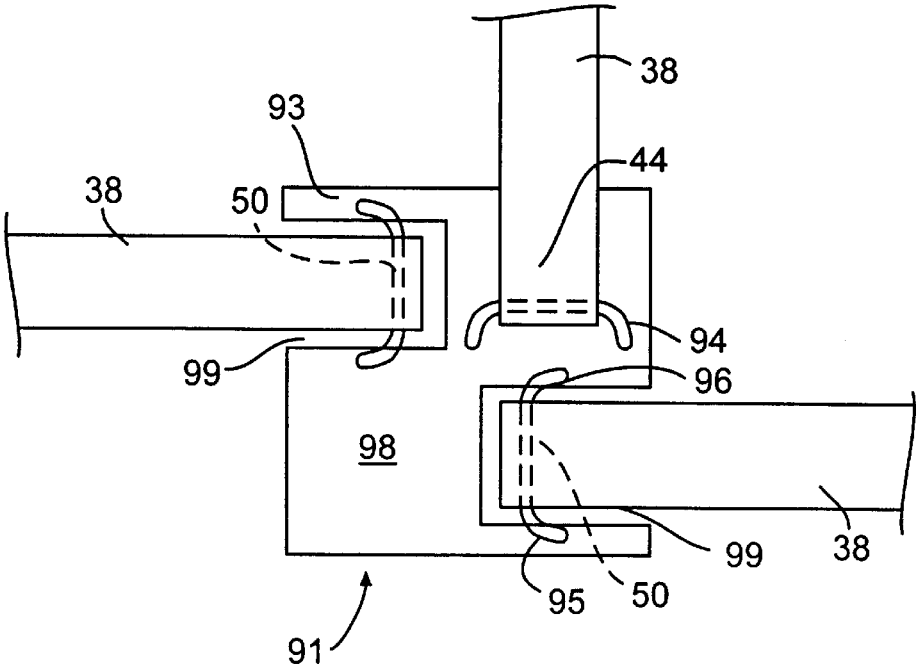
FIG. 6A is a top view of the fifth variation of the hub incorporated in the display framework of the present invention.

As previously described in the description of hubs 41, 61, to permit the manipulation of the display framework, seventh hubs 91 include seventh base portion 93, as illustrated in FIG. 6A. Base portion 93 is essentially identical to base portion 92 with the only difference being seventh openings 99. Openings 99 allow rods 38 to enjoy full rotation about the single axis of revolution. Because these rods enjoy full rotation, the display framework is easily manipulated between the erect and compact configurations.

Regardless of the particular hub configuration, the display framework 30, in the erect inverted V-shaped configuration, as illustrated in FIG. 1, presents enhanced rigidity and stability as provided by fastening mechanism 100. Fastening mechanism 100 rigidly connects and anchors front face 32 to rear face 34 of the erect display framework 30. While several variations of fastening mechanism 100, 110, 120 are contemplated by the present invention, the purpose fulfilled by the fastening mechanism is satisfied in each design.

The first embodiment of fastening mechanism 100 is depicted generally in FIG. 1 and in expanded detail in FIG. 1A. As illustrated, fastening mechanism 100 includes hook 102. Hook 102 extends from the end of a thin flexible elongated member 104, where the other end of elongated member 104 is affixed to interior side 105 of rod 38 proximate to rear face 34. Affixed to the opposing interior face 106 of rod 38 proximate to front face 32 is loop 108. As display framework 30 expands from its collapsed compact configuration to its erect inverted V-shaped position configuration, front face 32 opposes rear face 34. To rigidly connect front face 32 and rear face 34 and maintain an enhanced stability and rigidity for the erect inverted V-shaped configuration, elongated member 104 extends so that hook 102 fastens to loop 108. By design, the length of elongated member 104 is such that external pressure must be applied to front face 32 and rear face 34 to permit elongated member 104 to extend so that hook 102 may fasten to loop 108. Once fastened, the tension existent in elongated member 104 provides the erect display framework 30 with increased rigidity and stability. At minimum, fastening mechanism 100 need only be provided for one pair of opposing rods along each side of display framework 30. But if greater stability is desired, additional fastening mechanisms can be provided and dispersed along any number of opposing rods.

Figure 7:
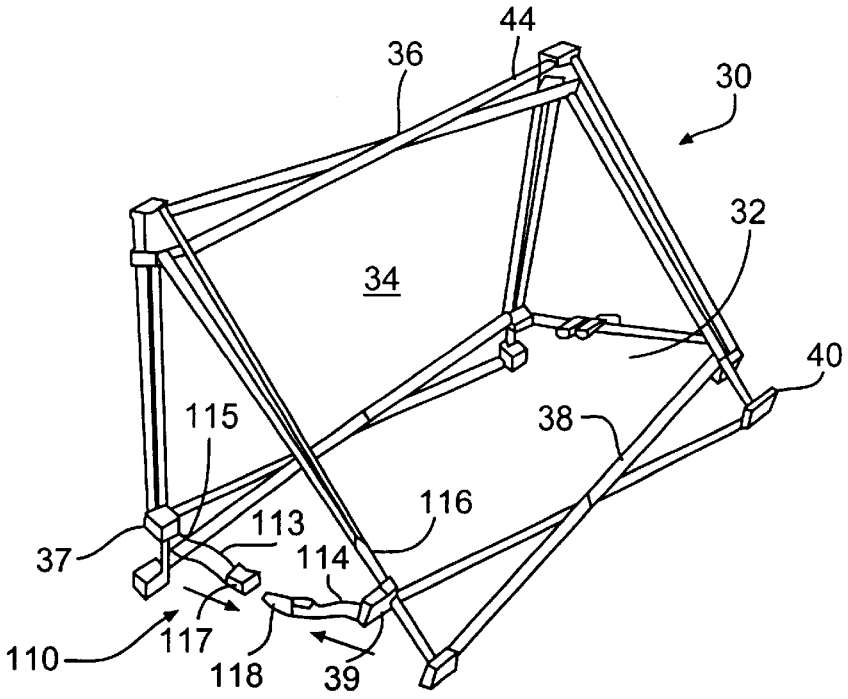
FIG. 7 is a perspective view of a preferred embodiment of the display framework according to the present invention, showing a second variation of the fastening mechanism.

As illustrated alternatively in FIG. 7, second fastening mechanism 110 includes complementary snapping structures 117, 118 attached to a first elongate member 113 and a second elongated member 114, respectively. End 115 of first elongated member 113 is affixed to hub 37 located proximate to lower portion of rear face 34 of the erect display framework 30. End 116 of second elongated member 114 similarly affixes to hub 39 proximate a lower portion of front face 32 of erect display framework 30. The other end of the first and second elongated members respectively attaches to complementary snapping structures 117 and 118. Structures 117 and 118 are designed to removably interlock once imposed onto one another. Connecting structure 117 to structure 118 provides a secure removable attachment between front face 32 and rear face 34. The combined connected length of first and second elongated members 113, 114 is such that pressure must be applied to front face 32 and rear face 34 to permit the complementary structures 117, 118 to interlock. Once interlocked, the tension existent in the connected elongated members provides the erect display framework 30 with enhanced rigidity and stability.

Figure 8:
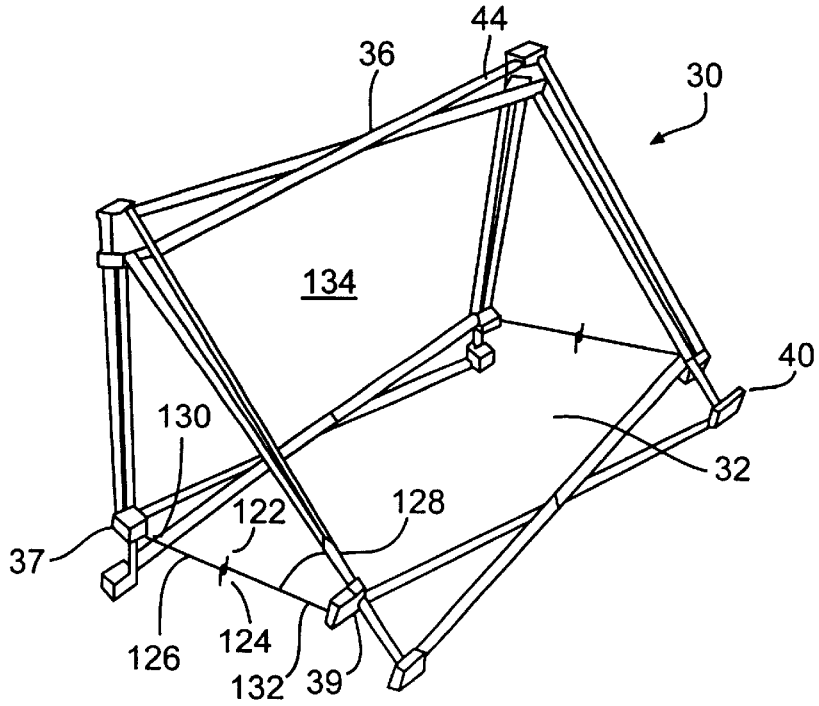
FIG. 8 is a perspective view of a preferred embodiment of the display framework according to the present invention, showing a third variation of the fastening mechanism.

In yet another variation, as illustrated in FIG. 8, third fastening mechanism 120 includes complementary hooks 122, 124 attached to a first elongated member 126 and a second elongated member 128 respectively. End 130 of first elongated member 126 is affixed to hub 37. Hub 37 is located proximate to a lower portion of rear face 34 of the erect display framework 30. Similarly, end 132 of second elongated member 128 affixes to hub 39. Hub 39 is located proximate to a lower portion of front face 32 of the erect display framework 30. The other ends of the first and second elongated members respectively attach to complementary hooks 122, 124. Hooks 122 and 124 are designed to removably fasten once imposed and angled onto one another. Fastening hook 122 to hook 124 provides a secure removable attachment between front face 32 and rear face 34. The combined connected length of first and second elongated members 126, 128 is such that pressure must be applied to front face 32 and rear face 34 to permit complementary hooks 122, 124 to fasten. Once fastened, the tension existent in the connected elongated members provides erect display framework 30 with rigidity and stability.

Figure 9:
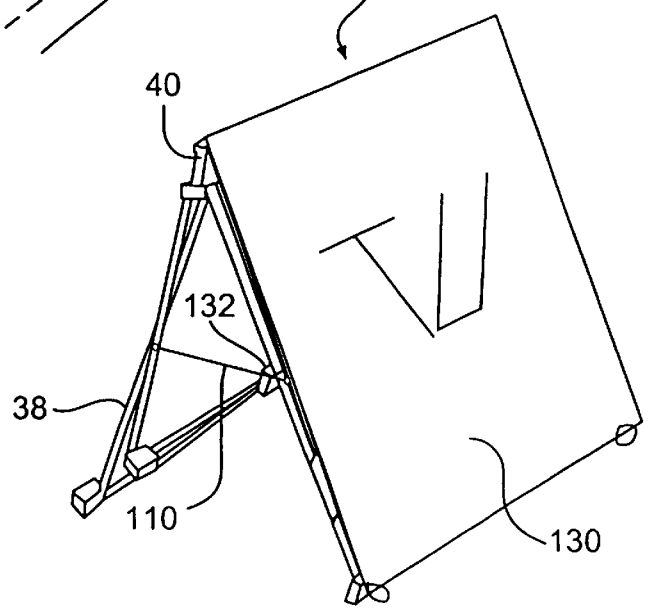
FIG. 9 is a perspective view of a preferred embodiment of the display framework according to the present invention, showing an illuminated display surface.

Display framework 30, in its erect configuration, may receive a display surface, as illustrated in FIG. 9. Display surface 130 is preferably constructed from a fabric material, which offers flexibility in appearance and handling. Display surface 130 affixes to display framework 30 by fastening the respective portions of display surface 130 to those hubs externally located in the erect configuration. Preferably, a hole is positioned along the exterior of base portion 45 of each hub 40 to provide an attachment base for an anchoring device that receives and retains display surface 130 to one or both of front face 32 and rear face 34. As attached, display surface 130 may removably affix to display framework 30, so that multiple displays may be positioned on front face 32 or rear face 34 at different times.

Regardless of whether display surface 130 is attached, display framework 30 is easily manipulated between its erect and compact configurations, because of the flexibility enjoyed by displace surface 130. For example, to return display framework 30 to its compact form, the fastening mechanism is first released so that front face 32 and rear face 34 are no longer rigidly connected. Next, front face 32 and rear face 34 are moved in opposing directions until rods 38 begin to collapse. Rods 38 will continue to collapse until all the rods lay substantially parallel to one another. As configured, the hubs, external in the erect from, are substantially side-by-side one another at one end of the rods, and the hubs, internal in the erect form, are substantially side-by-side one another at the other end of the rods. As manipulated, display framework 30 assumes a collapsed compact configuration.

Because of the rigidity and ease of manipulation of display framework 30, it may enjoys various uses. A number of these uses are illustrated in FIGS. 9–13 as exemplary only and not inclusive. For example, as illustrated in FIG. 9, display surface 130 can be enhanced by providing an illumination device 132 in the interior of erect display framework 30. As positioned, illumination device 132 enhances the appearance of display surface 130.

Figure 10:
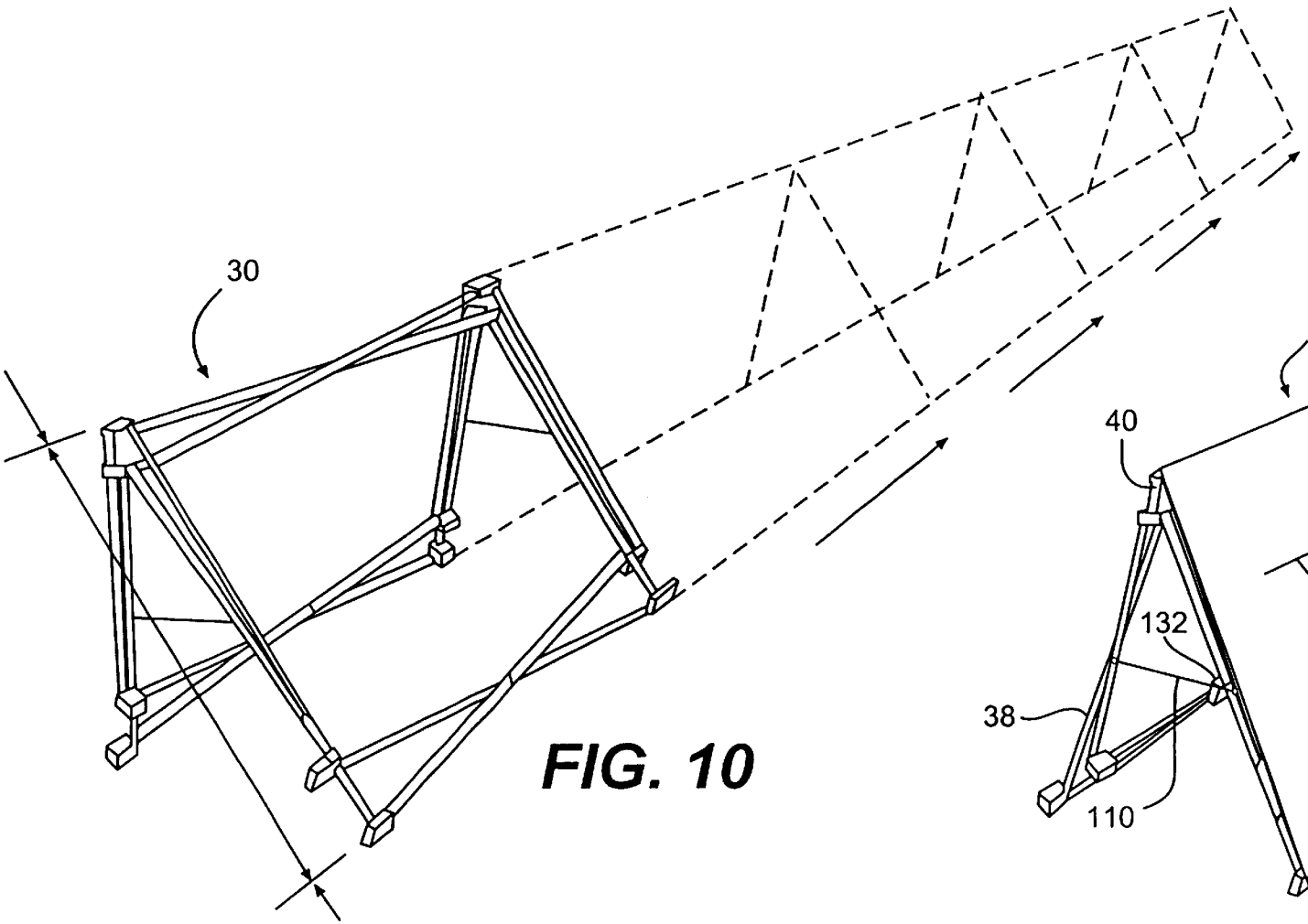
FIG. 10 is a perspective view of a preferred embodiment of the display framework according to the present invention, showing a plurality of display frameworks dispersed side-by-side one another.
Figure 11:
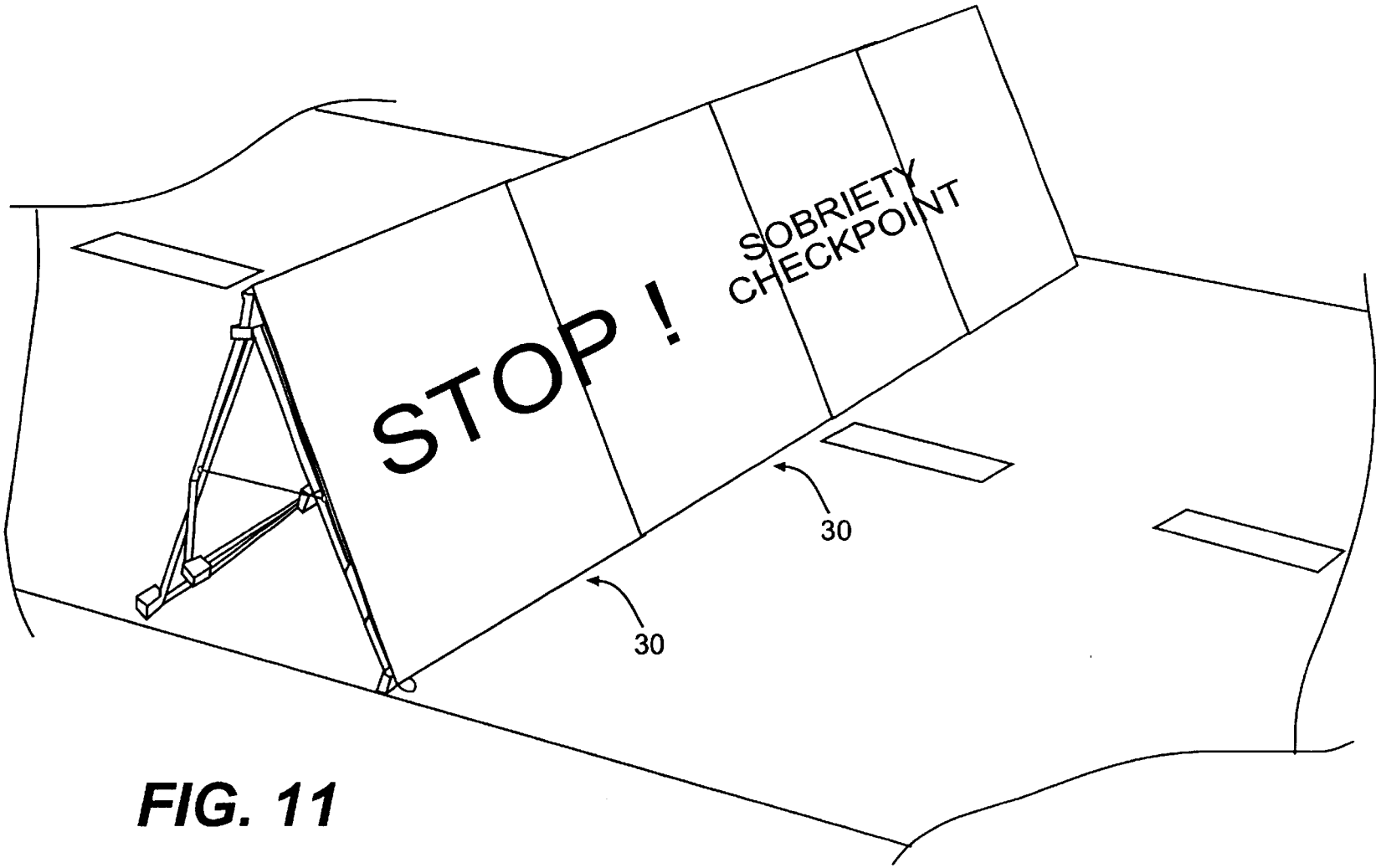
FIG. 11 is a perspective view of a preferred embodiment of the display framework according to the present invention, showing a plurality of display frameworks dispersed side-by-side one another.
Figure 12:
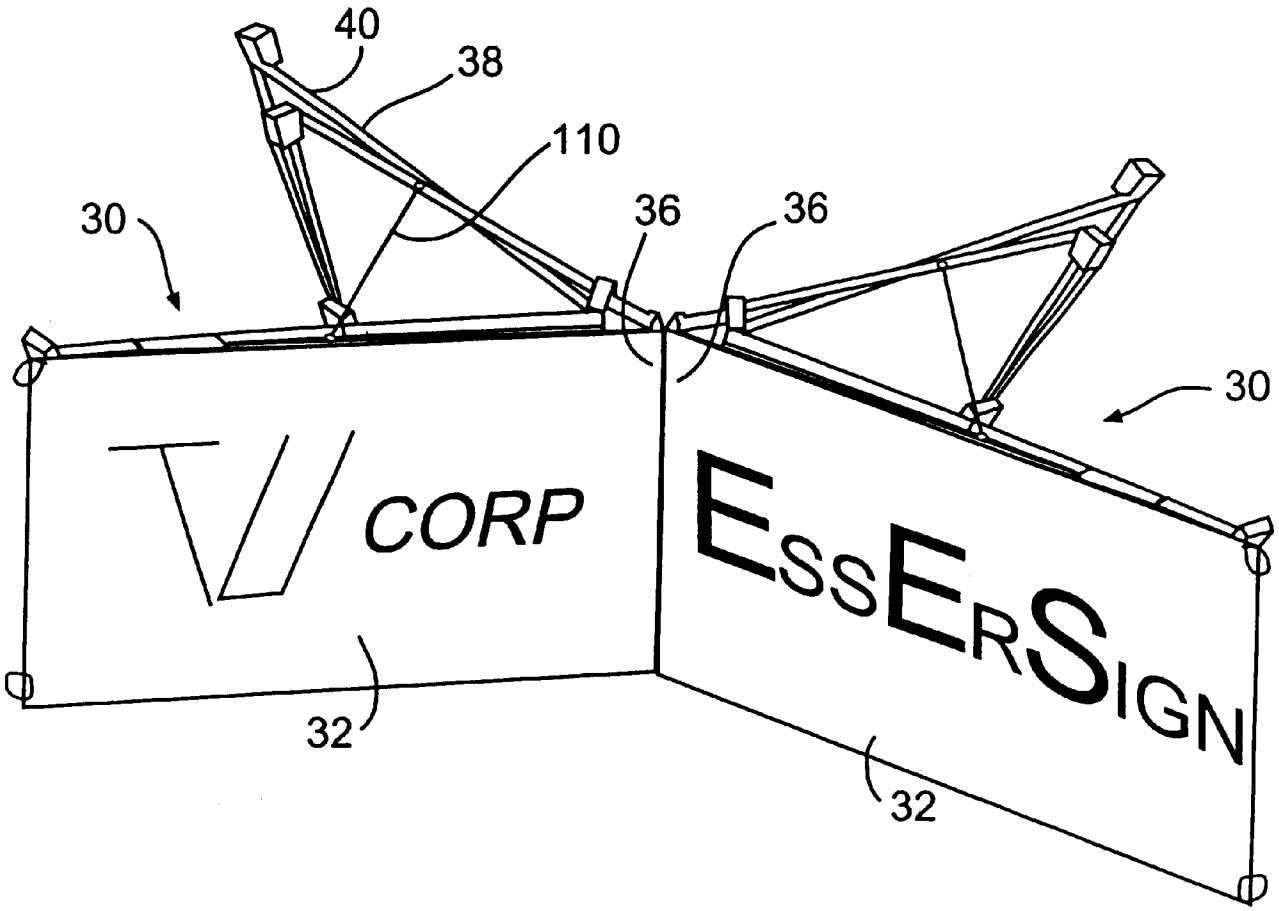
FIG. 12 is a perspective view of a preferred embodiment of the display framework according to the present invention, showing two display frameworks positioned on their sides and abutting at their tops.
Figure 13:
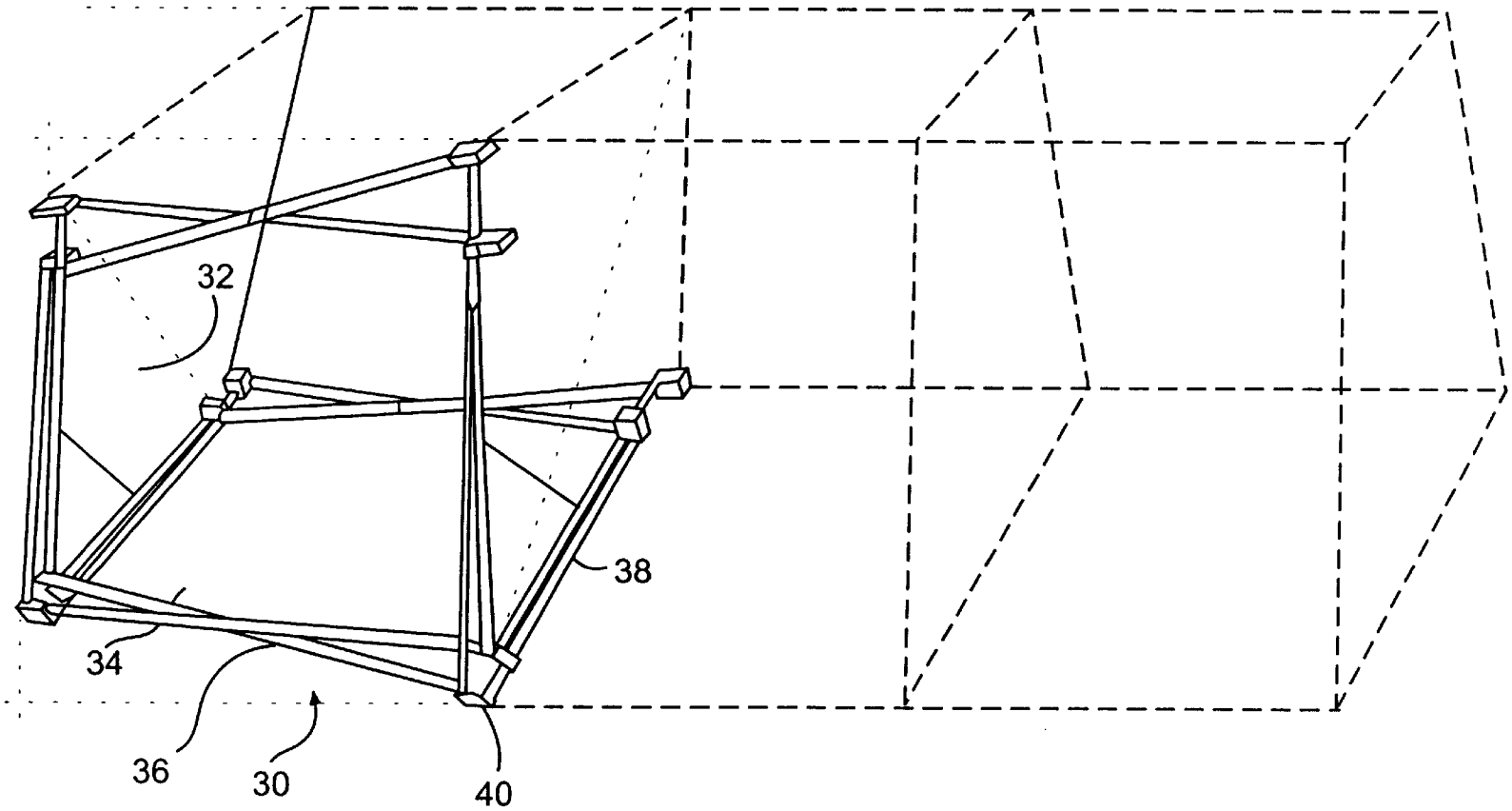
FIG. 13 is a perspective view of a preferred embodiment of the display framework according to the present invention, showing two display frameworks inter-connected at their respective bottom hubs to form a box-like structure.

Display surface 130 may also be enlarged, as illustrated in FIGS. 10–13. Display framework 30, in the erect configuration may be connected to other display frameworks 30. For example, as illustrated in FIGS. 10–11, multiple display frameworks 30 may be connected side-by-side. As positioned, the configuration of the display frameworks not only provide an increased display surface but may also act as a barricade of easily varied dimensions. Alternatively, as illustrated in FIG. 12, two erect display frameworks, positioned on their sides, may be connected at their respective tops 36 to increase the effective dimensions of the display framework. Further, multiple erect display frameworks may be positioned to engage one another to form various shapes. As illustrated in FIG. 13, for example, multiple display frameworks may be connected at their respective lower portion hubs to form a box, or similar, display structure. The corresponding lower portion hubs of front face 32 of two display frameworks may engage, while at the same time the corresponding lower portion hubs of rear face 34 of the same two display frameworks similarly engage. The dimensions of the box-like structure formed by the connected display frameworks may be extended by aligning multiple display frameworks of a similar box-like structure side-by-side.

It will be apparent to those skilled in the art that various modifications and variations can be made in the display of the present invention and in construction of this display framework without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A display framework adapted to support a display, the display framework being convertable between an erect inverted V-shaped configuration and a collapsed compact configuration, the display framework in the inverted V-shaped configuration having an apex, a front face, and a rear face, the display framework comprising:

rods, each rod being pivotally joined to another rod by a scissors connection intermediate the ends of said rod;

hubs, each hub receiving an end portion of at least two rods along separate axes of each hub, said rods being pivotally joined to said hubs, where each of said rods pivot in relation to said hub along a single axis of rotation, said rods being rotatable about the single axis of revolution from the collapsed configuration, where said rods are substantially parallel to one another and where said hubs are positioned adjacent one another at each end portion of the collapsed framework, to the erect inverted V-shaped configuration, at least two of the hubs positioned proximate the top portion of the collapsed framework articulating downward toward the bottom portion of the framework when converting from the collapsed configuration to the erect configuration; and a fastening mechanism connecting the front face to the rear face of the framework, said fastening mechanism disposed proximate the lower portion of the framework in the erect inverted V-shaped configuration.

2. The display framework recited in claim 1, wherein each of said hubs includes flanges, said flanges receiving the ends of said rods.

3. The display framework recited in claim 2, wherein the end portion of each of said rods is pivotally joined to one of said flanges by a pin inserted through the end portion of said rod and received on said flange.

4. The display framework recited in claim 2, wherein at least two of said flanges lay substantially perpendicular to one another, whereby each of said hubs receives rods along a first axis and a second axis perpendicular to the first axis.

5. The display framework recited in claim 4, wherein the ends of said substantially perpendicular flanges bend at right angles in either a clockwise or counterclockwise direction.

6. The display framework recited in claim 5, wherein the end portion of each of said rods is pivotally joined to said flange by a pin inserted through the end portion of said rod and received on two of said flanges.

7. The display framework recited in claim 1, wherein each of said hubs includes a base portion, the end portion of each of said rods being pivotally joined to said base portion by a pin inserted through the end portion of said rods and received on said base portion.

8. The display framework recited in claim 2, wherein said hub includes a base portion, said flanges projecting from said base portion.

9. The display framework recited in claim 8, wherein said base portion of at least one hub limits rotation of each of said rods in relation to said hub.

10. The display framework recited in claim 8, wherein said hubs proximate the top of the erect framework include external hubs lying in a first plane and internal hubs lying in a second plane vertically spaced apart and parallel to the first plane, said base plate of said internal hubs allowing full rotation of at least two of said rods in relation to said hub.

11. The display framework recited in claim 10, wherein said hubs proximate a lower portion of the front face and the rear face of the framework receive less rods than said hubs proximate the top of the framework.

12. The display framework recited in claim 1, wherein each of said rods pivotally joined to each hub radiate outwardly from one another in the erect inverted V-shaped configuration.

13. The display framework recited in claim 1, wherein the framework in the erect configuration includes internal hubs and external hubs, the external hubs being positioned proximate a top portion of the collapsed framework and the internal hubs being positioned proximate a bottom portion of the collapsed framework.

14. The display framework recited in claim 13, further comprising:

a display support affixed to an exterior surface of said external hubs, said display support being flexible.

15. The display framework recited in claim 14, wherein said display support is substantially overlaying the front face, the rear face, and the apex in the erect inverted V-shaped configuration and is substantially compact in the collapsed configuration.

16. The display framework recited in claim 14, wherein a display removably affixes to the portions of said display support proximate said external hubs.

17. The display framework recited in claim 1, wherein each rod is of substantially equal length and wherein said scissor connection is proximate the middle of each rod.

18. The display framework recited in claim 17, wherein the horizontal and vertical dimensions of the front face and the rear face are substantially equivalent.

19. The display framework recited in claim 18, wherein at least two of said rods have a telescoping member, said rods having a hollow interior whereby said hollow interior slidably receives a small rod in said rod to provide extension of the display framework in the vertical and horizontal direction.

* * * * *